US005112188A

United States Patent [19]

Barnetche-Gonzalez

[11] Patent Number: 5,112,188

[45] Date of Patent: May 12, 1992

[54] MULTIPLE STAGE DRAG AND DYNAMIC TURBINE DOWNHOLE MOTOR

[76] Inventor: Eduardo Barnetche-Gonzalez, Rio Grijalva No. 11, Col. Vista Hermosa, Cuernavaca, Moselos, Mexico

[21] Appl. No.: 654,423

[22] Filed: Jan. 25, 1991

[51] Int. Cl.[5] ..... F01D 9/00; F03B 13/00

[52] U.S. Cl. ..... 415/198.1; 415/901; 415/903; 415/74; 416/177; 175/107

[58] Field of Search ..... 415/901, 903, 71, 72, 415/73, 74, 53.1; 416/176, 177; 175/107

[56] References Cited

U.S. PATENT DOCUMENTS

| | | | |
|---|---|---|---|
| 466,751 | 1/1892 | Gardner . | |
| 3,404,924 | 10/1968 | Choate . | |
| 3,405,912 | 10/1968 | Lari et al. . | |
| 3,728,040 | 4/1973 | Ioanesian et al. . | |
| 3,966,369 | 6/1976 | Garrison | 175/107 |
| 3,989,409 | 11/1976 | Ioannesian | 415/903 |
| 4,146,353 | 3/1979 | Carrouset . | |
| 4,225,000 | 9/1980 | Maurer . | |
| 4,265,323 | 5/1981 | Juergens | 415/502 |
| 4,415,316 | 11/1983 | Jurgens . | |
| 4,427,079 | 1/1984 | Walter | 175/107 |
| 4,676,716 | 6/1987 | Brudny-Chelyadinov | 415/903 |
| 4,773,489 | 9/1988 | Makohl . | |

FOREIGN PATENT DOCUMENTS

| | | |
|---|---|---|
| 662734 | 7/1938 | Fed. Rep. of Germany . |
| 1159988 | 7/1958 | France . |
| 272885 | 3/1930 | Italy . |
| 11563 | of 1899 | United Kingdom . |
| 781860 | 8/1957 | United Kingdom . |

OTHER PUBLICATIONS

"Hydraulic Downhole Drilling Motors Turbodrills and Positive Displacement Rotary Motors", Tiraspolsky, edited by Gulf Publishing Co., 1985.

*Primary Examiner*—Edward K. Look
*Assistant Examiner*—Michael S. Lee
*Attorney, Agent, or Firm*—Armstrong, Nikaido, Marmelstein, Kubovcik & Murray

[57] ABSTRACT

A multistage turbine is provided for driving a downhole motor, which is driven by the flow of a fluid therethrough. The turbine comprises a housing and a shaft positioned in the housing, the shaft rotating about the longitudinal axis thereof. A plurality of turbine stages are mounted on the shaft for rotation therewith, each turbine stage including a rim coaxial with the shaft and a plurality of turbine blades fixed to the rim. A plurality of flow directing stators are positioned between adjacent turbine stages, each of the stators having a wall portion and diverter portion, wherein the wall portions are perpendicular to the axis of the shaft and the diverter portions are at an angle of less than 90° with respect to the axis of the shaft. At least one of the turbine blades and the diverter portions form a seal for preventing the flow from passing therebetween, such that flow through a turbine stage is perpendicular to the axis of the shaft in the space between adjacent wall portions and wherein the diverter portions are positioned with respect to said wall means for diverting flow from the turbine stage to an adjacent turbine stage. The turbine blades are positioned between adjacent stators such that flow between the wall portion of adjacent stators contacts the edges of the turbine blades, thereby imparting a drag force on the turbine blades and flow through adjacent diverter portions impinges upon the face surface of the turbine blades, thereby imparting a dynamic force on the turbine blades, whereby the turbine blades are rotated by the combination of the drag forces and dynamic forces thereon.

11 Claims, 16 Drawing Sheets

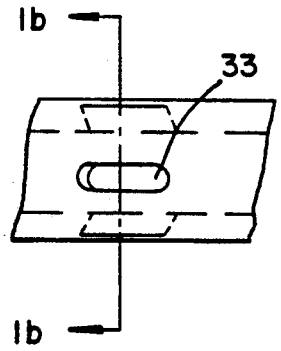
FIG.1a
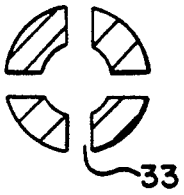
FIG.1b
FIG.3b
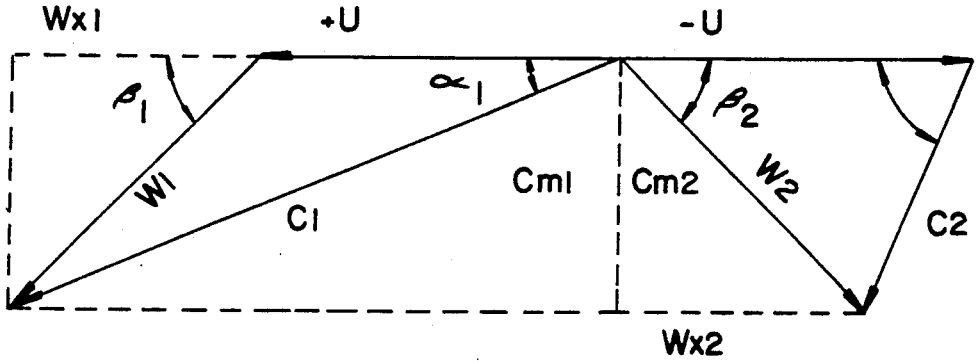
FIG.3a
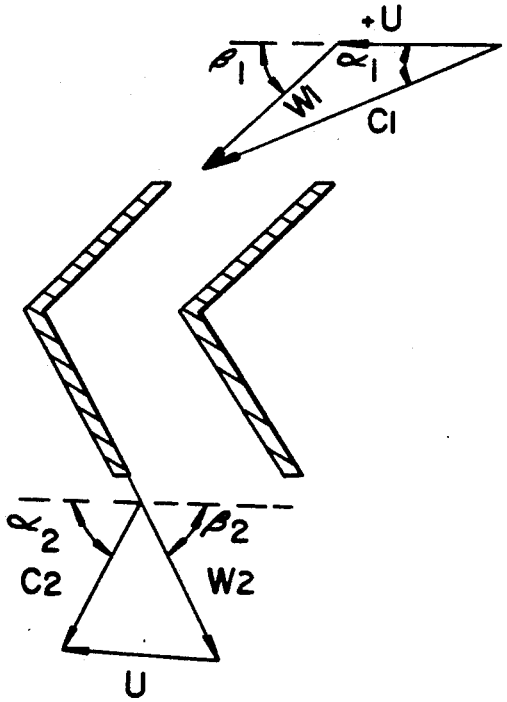

MULTIPLE STAGE DRAG AND DYNAMIC TURBINE DOWNHOLE MOTOR

BACKGROUND OF THE INVENTION

1. Field of the Invention

The present invention is directed to a multiple stage turbine for use as a downhole motor on a drilling string, and more particularly, to a multiple stage turbine downhole motor which is driven by the drag or shear stress force alone or in combination with the dynamic or impulse force of the fluid flowing through the turbine.

2. Description of the Prior Art

Prior art downhole motors for use on drilling strings convert the kinetic energy of a mass of a fluid against the face surface of turbine blades into power for turning a drill string and thereby a drill bit attached to the bottom of the drill string. The turbines rely solely on the dynamic or impulse force. Prior art downhole motors of this type are generally required to be relatively long in order to have sufficient turbine blade surface area for generating enough power to turn the bit at the proper speed with sufficient torque. However, because the downhole motor itself is quite long, it is difficult for the drill string to move through curves and thus it is much more difficult to control the direction of drilling.

Another disadvantage of the dynamic force type downhole motors, is that maximum power and efficiency occur at rather high rotational speeds; higher than the range of operational speed for most mechanical drill bits, like tricone bits. The reason for this characteristic is that the functions of power and efficiency, in terms of the velocity of the flow is proportional to the square of the velocity. The function is a parabola in which the apex is approximately midway between zero and runaway or no load speed.

Still another disadvantage of prior art downhole turbine motors is that the turbine blades are internal with respect to the drilling shaft. In order to drive the turbine, fluid must flow through the internal structure of the drill string and can cause damage to the bearings, seals and other internal parts of the downhole motor.

SUMMARY OF THE INVENTION

A helical multiple impulse hydraulic downhole motor is described in my prior U.S. patent application Ser. No. 045,822, filed May 4, 1987, now abandoned. This application is incorporated herein by reference.

It is the primary object of the present invention to provide a multiple stage turbine which operates by using the shear force of the fluid on the edges of the blades of the turbine either alone or in combination with the impulse force of the fluid on the surface of the blades.

It is another object of the present invention to provide a downhole motor for use in turning a drilling string, and thereby a drill bit on the end of the drill string, which operates at a relatively slow speed of 300–500 rpm and produces high torque, with no torque on the pipe of the drill string itself.

It is another object of the present invention to provide a multiple stage turbine in which the rotor having the turbine blades, is external to the drilling shaft and thus the moving parts are external to the drilling shaft. Further, because the blades are attached to an external movable part, the generated forces are farther away from the axis of the turbine, giving more leverage and hence more torque.

The present invention is directed to a multistage turbine for driving a downhole motor, which is driven by the flow of a fluid therethrough. The turbine comprises a housing with a plurality of rims and a shaft positioned in the housing, the housing and rims rotating about the longitudinal axis thereof. A plurality of turbine stages are mounted on the housing for rotation therewith, each turbine stage including a rim coaxial with the shaft and a plurality of turbine blades fixed to each rim. A plurality of flow directing stators are positioned between adjacent turbine stages, each of the stators having a wall portion and diverter portion, wherein the wall portions are perpendicular to the axis of the shaft and the diverter portions are at an angle of less than 90° with respect to the axis of the shaft. At least three of the turbine blades and the diverter portions form a seal for preventing the flow from passing therebetween, such that flow through a turbine stage is perpendicular to the axis of the shaft in the space between adjacent wall portions and wherein the diverter portions are positioned with respect to said wall means for diverting flow from the turbine stage to an adjacent turbine stage.

The turbine blades are positioned between adjacent stators such that flow between the wall portion of adjacent stators contacts the edges of the turbine blades, thereby imparting a drag force on the turbine blades and flow through adjacent diverter portions impinges upon the face surface of the turbine blades, thereby imparting a dynamic force on the turbine blades, whereby the turbine blades are rotated by the combination of the drag forces and dynamic forces thereon.

BRIEF DESCRIPTION OF THE DRAWINGS

FIG. 1*a* is an expanded view of a portion of FIG. 1.

FIG. 1*b* is a sectional view through Section 1*b*—1*b* in FIGS. 1 and 1*a*.

FIGS. 3*a* and 3*b* are diagrams for analyzing the flow and forces in a turbine of the present invention.

DETAILED DESCRIPTION OF THE PREFERRED EMBODIMENTS

The present invention is directed to a multiple stage turbine which comprises a plurality of single stages, each of which operates on the principle of the shear stress of fluid flowing in passages or spaces in the stage against the edges of the turbine blades which generate drag forces either alone or in combination with impulse forces of the fluid against the surface of the blades. The volume of flow is not a factor as to the drag force or the shear forces on the edges of the turbine blades. The power produced by the drag force is a function of the relative velocity and drag surface, the drag surface being the edges of the turbine blades, and not the surface or face of the blade itself. The use of the drag force results in a higher torque then a conventional turbine rotor of the same dimensions. This enables the motor of the present invention to generate sufficient torque using less stages, which in turn enables it to be shorter in length than a conventional turbine motor.

Figure 1:
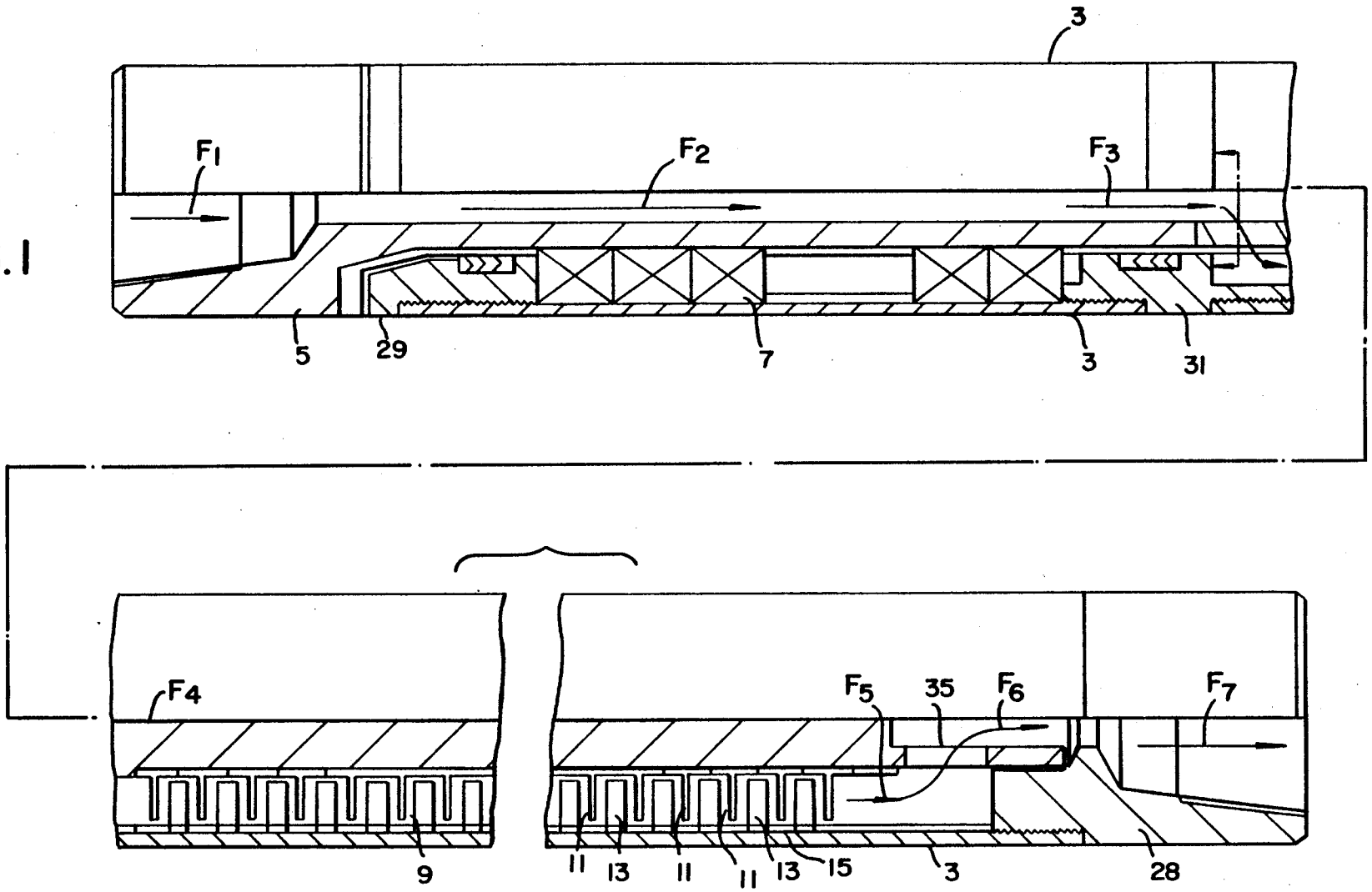
FIG. 1 is a sectional view of a downhole motor of the present invention.

FIG. 1 is an elevational view of a downhole motor 1 which comprises an outer casing 3 and an inner shaft 5. The motor further includes a bearing assembly 7 and a turbine assembly 9 having a plurality of stages, each stage having a stator and rotor assembly. Each stator assembly comprises a plurality of flow directing stators 11 and each rotor assembly comprises a plurality of turbine blades 13 which are fixed to a rotor rim 15.

A plurality of turbine rotors 13 are pre-loaded and held together by means of nuts 28 and 29 located at the ends of the downhole motor. A drill bit (not shown) may be connected to nut 28. These nuts also hold the bearing assembly 7 in place. The bearings 7 may be tapered journal bearings or other types of bearings such as ball bearings. If necessary, nuts for holding the assembly together can be used as intermediate portions of the motor. Block 31 provides separation between the bearing assembly 7 and the turbine assembly 9 and forms a seal therebetween. Block 31 can also be used to house a pressure compensator for the bearing lubrication system, should such pressure compensation be necessary.

Referring to FIGS. 1, 1*a* and 1*b*, fluid, the flow of which is illustrated by arrows F1–F7, flows through the downhole motor 1 as shown. Flow starts at F1–F3 axially through the center of shaft 5, between F3 and F4, the fluid flows through a plurality of slots 33 in the shaft 5. Between F4 and F5, the fluid flows through the turbine assembly 9, rotating the turbine blades 13 and the outer casing 3. End piece 28 is screw-threaded into outer casing 3 and tightened against blades 13 to thereby cause the blade 13 to rotate with the outer casing 3. At F5–F6, the fluid then flows out of the turbine assembly 9 and into the shaft 5 through additional slots 35, which are the same as slots 33, and then exits from the downhole motor into the bore hole. As can be seen, the turbine assembly is mounted on the outside of the shaft 5, thus, the moving parts are external to the drill shaft.

Figure 2:
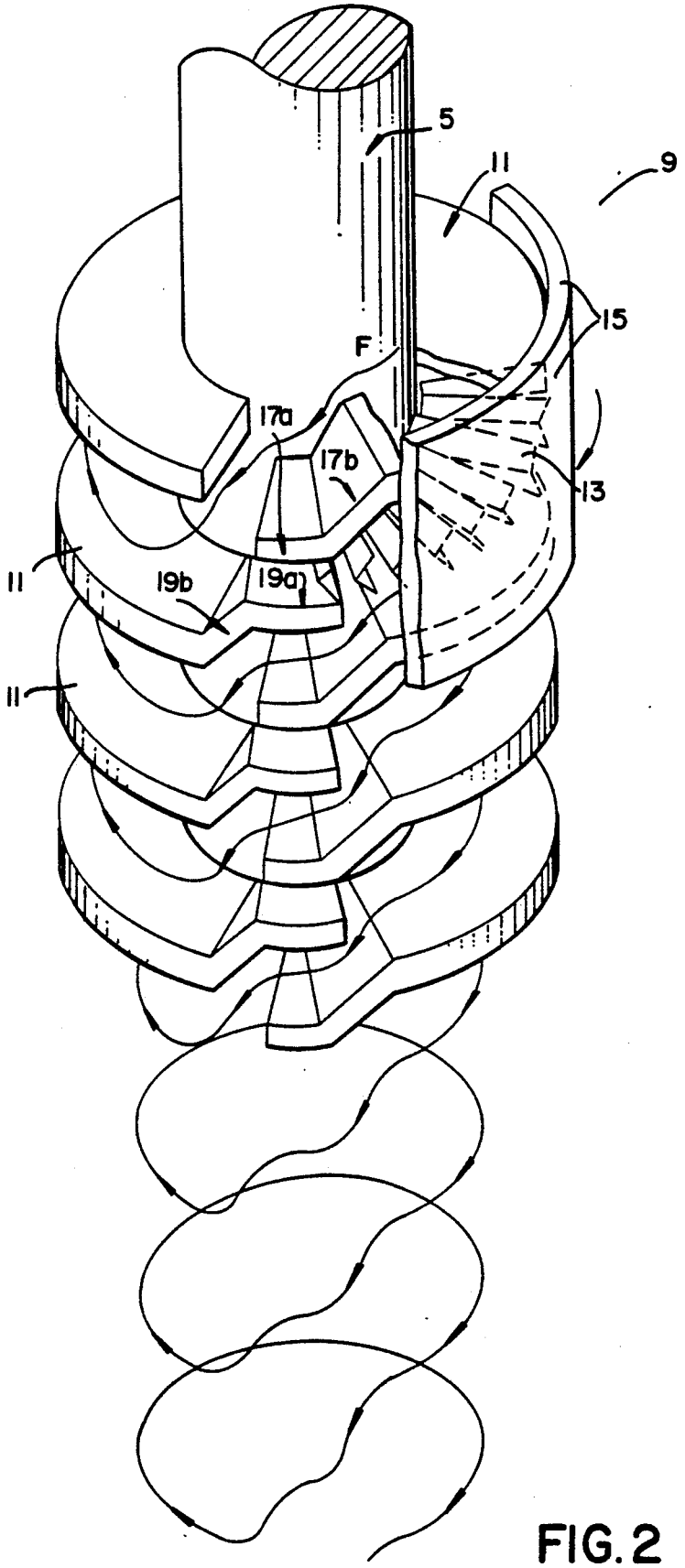
FIG. 2 is a perspective view of the flow through a turbine of the present invention.

FIG. 2 shows the flat helical flow path through a turbine assembly 9. The turbine assembly is mounted on a shaft 5. The turbine assembly includes a plurality of flow directing stators 11 fixed to the shaft 5, with a plurality of turbine blades 13 being fixed to the corresponding rotor rim 15 being positioned to rotate between adjacent stators 11 (See FIG. 1). A seal is formed between flow directing portions 19*b* and 19*a* and the turbine blades 13 so that the flow F is circular in the channel or space formed between adjacent stators 11 and then flows through the channel or space between the flow diverters 17*a* and 17*b* and 19*a* and 19*b* into an adjacent turbine stage between the next adjacent stators 11. Thus as can be seen, the flow follows a flat circular path through almost an entire 360° and then a somewhat helical path diagonally downward into the next turbine stage. The drag forces and impulse forces applied to the turbine blades by the flow through the turbine will depend upon the configuration of the turbine blades 13 and the stators 11 as will be explained in more detail below.

The turbine of the present invention is driven by the shear stress or drag force in combination with the dynamic or impulse force of the fluid flowing through the turbine. The drag force is generated by the flow of fluid against the edges of the turbine blades. The dynamic force is generated by the impact of the flow against the surface of the face of the turbine blades as its flows through the rotor blades at the entrance and the outlet of each turbine stage.

The total force acting on the rotor is:

$$F_T = Fdr + Fdy \quad (1)$$

where:

Fdr = shear force or drag force

Fdy = impulse or dynamic force

The drag force is as follows:

$$Fdr = \gamma \lambda dr\, a_{dr} u,\ (C-u)^2/2g \quad (2)$$

where:

$\gamma$ = specific weight of the fluid (Kgf/m$^3$).

$\lambda$dr = drag coefficient (dimensionless) from rotor blades and channels geometrical configuration.

C = mean velocity of the flow through the drag channels (m/sec).

u = peripheral velocity of the rotor (m/sec).

$a_{dr}$ = drag area upon which the shear stress acts (m$^2$).

The dynamic force can be calculated with reference to FIG. 3*a* which is a section of the rotor blades, transverse to the axis of rotation wherein:

u = tangential velocity of the rotor (m/sec).

$w_1$ = relative velocity of the flow (m/sec).

$\beta_1$ = angle of $w_1$ with the direction u (degrees).

$C_1$ = absolute velocity, vectorial addition of of u and $w_1$.

$\alpha_1$ = angle of C, with the direction of u.

$w_{x1}$ = component of $w_1$ in the direction of movement u.

The subscript "1" corresponds to the inlet of the flow for every change of direction through the blade assembly.

The subscripts "2" are used to denote the corresponding values of the flow at the outlet of every change of direction, generating a hydraulic impulse.

In order to deduce or obtain the equation for the dynamic force, referring to FIG. 3*b*, shows the composition of the triangles of velocities at the inlet and outlet of the flow at every impulse or change of direction.

According to Newton's Second Law:

$$Fdy=\rho Q\,(w_{x1}-w_{x2}) \quad (4)$$

wherein:

$w_{x1}$ and $w_{x2}$ are the components of the relative velocities in the direction of the movement.

$$\rho = \text{specific mass} = \frac{\gamma}{g}$$

Then:

$$w_{x1} = C_1 \cos\alpha_1 - u.$$
$$w_{x2} = Cm_2 \div \tan\beta_2 = Cm_1 \div \tan\beta_2.$$
$$C_1 \sin\alpha_1 \div \tan\beta_2.$$

and $$Fdy=m\,\rho Q[(C_1\cos\alpha_1-u)+C\sin_1/\tan\beta_2] \quad (3)$$

wherein:

m=number of changes of direction or impulses in each stage.

Figure 4:
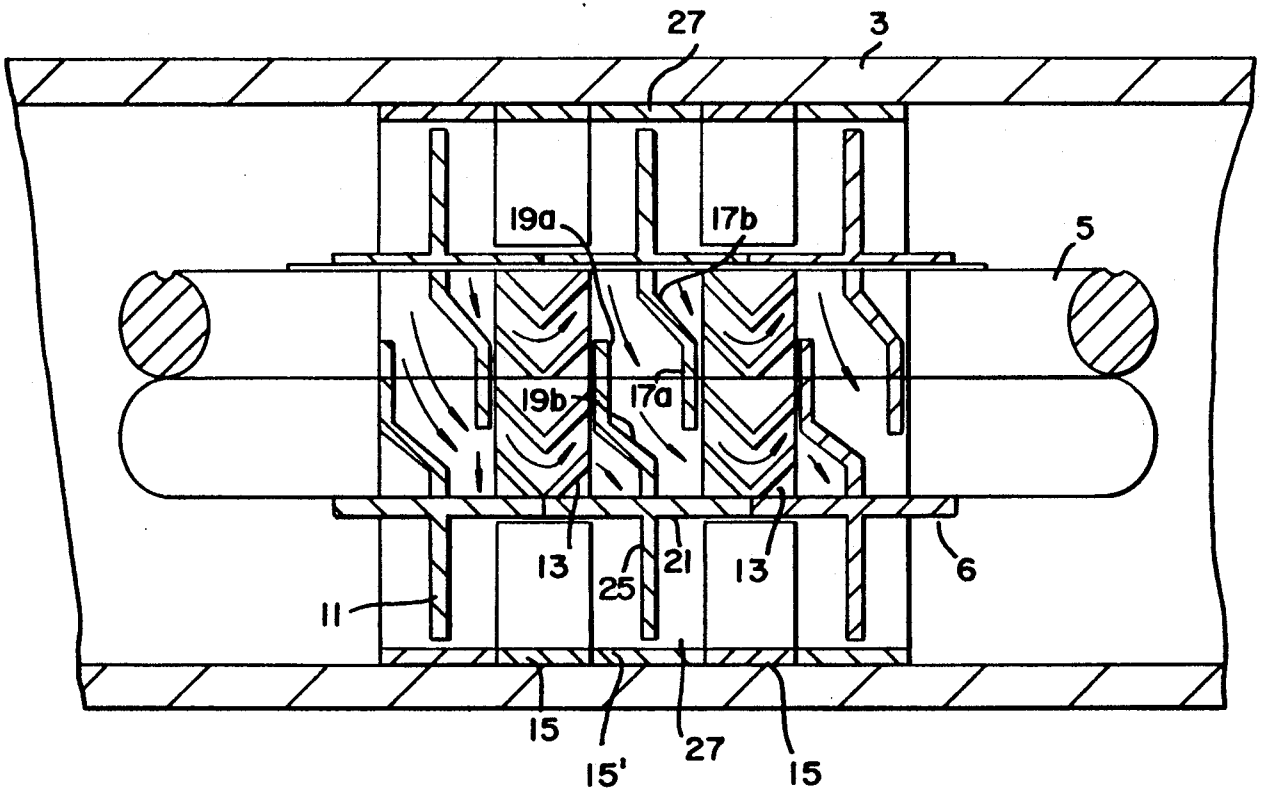
FIG. 4 is a partial sectional view of a turbine of a first embodiment of the present invention.
Figure 5:
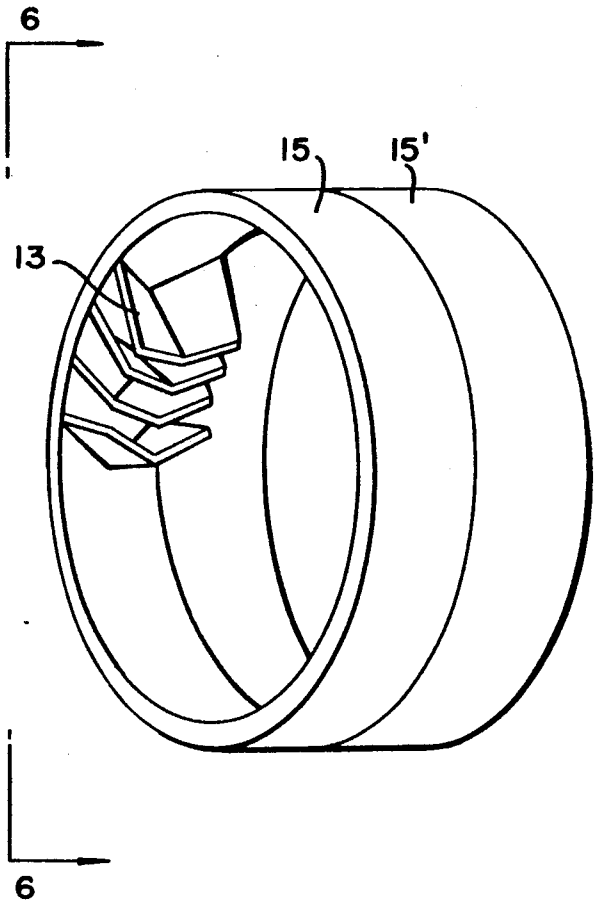
FIG. 5 is a perspective view of a rotor stage of the present invention.
Figure 6:
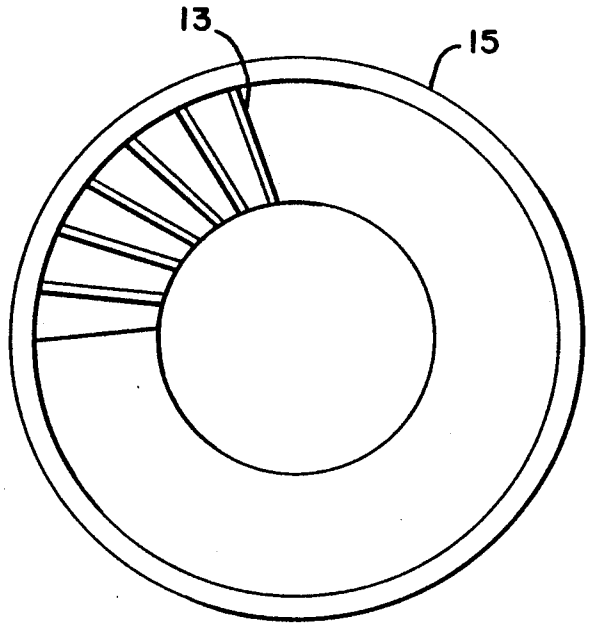
FIG. 6 is a front view of the rotor stage of FIG. 5.

Referring to FIGS. 4–6, it can be seen that the blades 13 are fixed to rotor rims 15. Although only four blades are shown, the remaining blades are positioned around the entire rim 15. When a plurality of rotor assemblies are used as shown in FIG. 1, the rim 15 can have a width equal to the width of the turbine blades 13 and a spacer 15' can be positioned adjacent to the rim 15. Alternatively, the rim 15 can be made wider than the blade 13 so that the spacer 15' is an integral portion thereof. FIG. 6 is an elevation view taken in plane 6—6 of FIG. 5 showing the orientation of blades 13 with respect to rim 15 and the center of rim 15. Although the blades 13 are shown in a V-shape cross-section, other cross-sections can be used such as a rounded V, offcenter V, a combination of round and offcentered Vs, etc.

Figure 7:
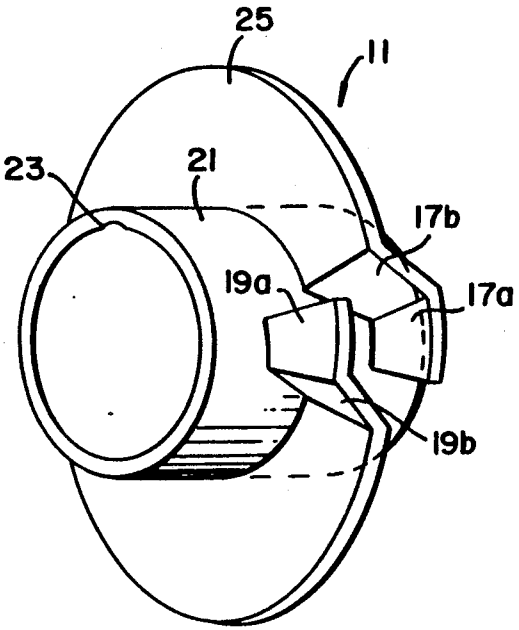
FIG. 7 is a perspective view of a stator of the first embodiment of the present invention.

FIG. 7 is a perspective view of a flow directing stator 11. Stator 11 has wall portions 25 and flow diverting portions 17*a* and 17*b* and 19*a* and 19*b*. Flow diverting portions 17*a* and 19*a* form seals with adjacent turbine blades 13, as shown in FIG. 2. Although the seal is not a perfect seal since it is necessary for the turbine blades to rotate, the seal substantially stops the flow of fluid thereby maintaining the proper flow path through the turbine assembly as will be described below. The stator 11 further comprises a hub 21 having a keyway 23 for receiving the key 6 when the stator is mounted on the shaft 5. The stator assembly further includes a wall portion 25 integrally formed with the flow directing portions. As shown in FIG. 4, a space 27 is formed between wall portion 25 and spacer 15'. The space 27 is made very small so that the flow of fluid through the space is negligible, but the space is sufficient to permit the rotation of rotor 13 with respect to stator 11.

Figure 8:
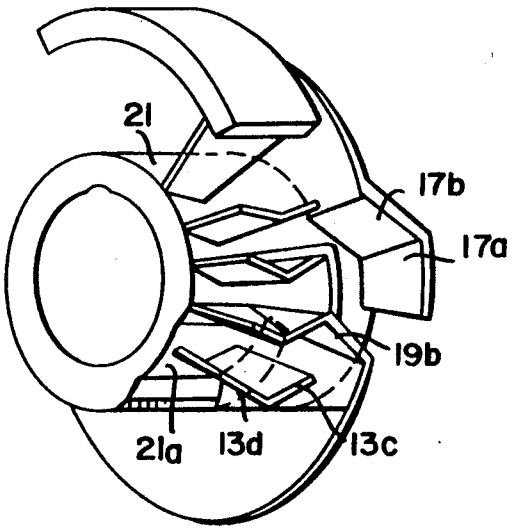
FIG. 8 is a perspective view of an alternate embodiment of a stator of the present invention.

FIG. 8 is an alternative embodiment of the stator 11 in which the hub 21 has a reduced diameter portion 21*a*. The length or angle of the reduced portion will depend upon the particular flow characteristics but generally will be less than 90°. The purpose of the reduced hub radius is to allow the fluid to flow under the blades 13*c*, thereby eliminating the impulse forces on blades 13*c* and to quickly equalize the flow on both sides of the blades 13*d*. If desired, the sharp corners between surfaces 17*a* and 17*b*, and 19*a* and 19*b* can be rounded in order to smooth the flow and reduce turbulence.

Figure 9:
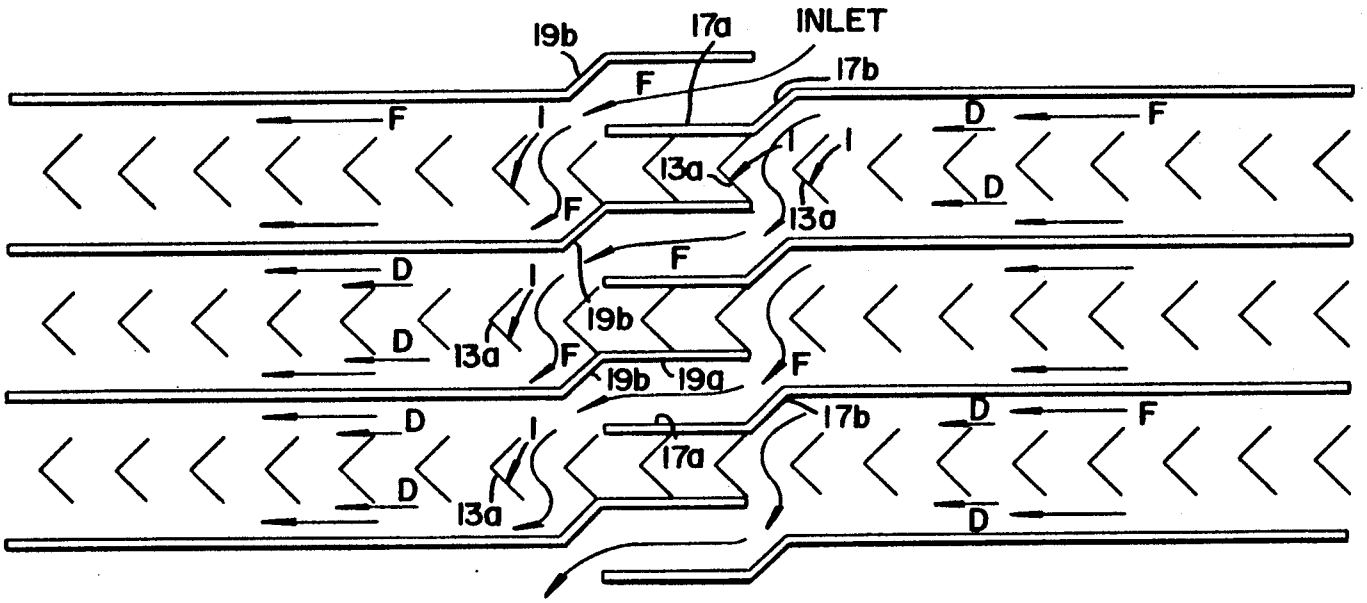
FIG. 9 is a partial layout illustrating the flow of fluid through a first embodiment of the turbine of the present invention.

FIG. 9 is a partial layout illustrating the flow of fluid through two blade assemblies 13 in a first embodiment of the turbine of the present invention. The arrows F show the flow and the arrows D and I illustrate the drag and dynamic forces on the turbine blades 13. Starting from the right, the flow F causes a drag force D on the edges of the turbine blades 13. When the flow reaches surface 17*b*, it is diverted downward as shown, striking the blades 13*a* and applying a dynamic force I to the blades 13*a*. Flow then continues through flow diverters 19*a* and 19*b* into the adjacent stage of turbine blades and again dynamic forces I are applied to blades 13*a*. Flow then continues towards the left where only drag forces are applied to the edges of the blades 13.

Figure 10:
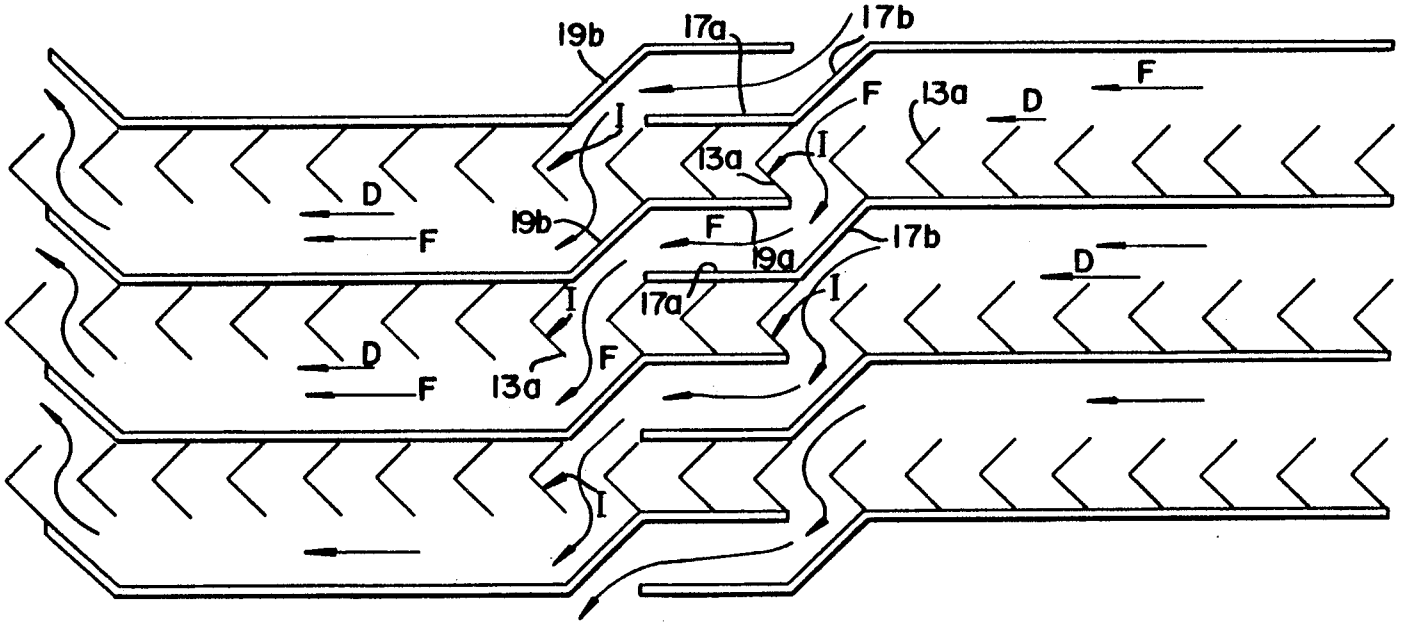
FIG. 10 is a partial layout illustrating the flow of fluid through a second embodiment of the turbine of the present invention.

FIG. 10 is a partial layout illustrating the flow of fluid through a second embodiment of the turbine of the present invention in which three impulses are produced in each stage. The arrows F show the flow and the arrows D and I illustrate the drag and dynamic on the turbine blades 13. Starting from the right, the flow F causes a drag force D on only one edge of the turbine blades 13. In the embodiment of FIG. 8, the turbine blades are configured so that the drag force is on both edges of the blades. When the flow reaches surface 17*b* it is diverted downward, as shown, striking the blades 13*a* and applying a dynamic force I to the blades 13*a*. The flow then continues through flow diverters 19*a* and 19*b* into the adjacent stage of turbine blades 13 and again dynamic forces are applied to blades 13*a*.

In the embodiment of FIG. 10, there are three changes of direction so three impulses are generated in every stage. In the equation (3), in this case the value of parameters "m" would be three.

Figure 11:
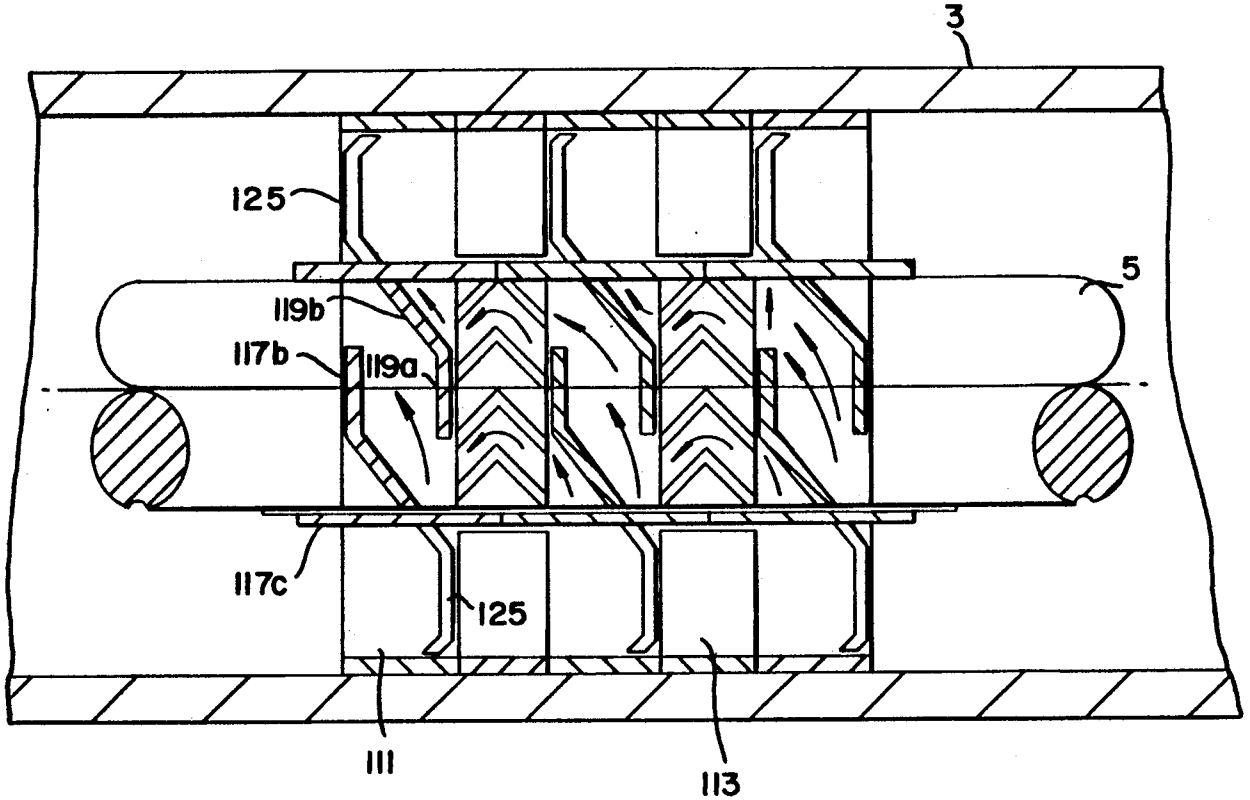
FIG. 11 is a partial sectional view of a turbine of a second embodiment of the present invention.

FIGS. 11–15 illustrate a third embodiment of the turbine of the present invention. In FIG. 11, flow directing stators 111 include diverter portions 117*a*, and 117*b* and 119*a* and 119*b* and wall portions 125. The turbine blade stages 113 are the same as those described in the embodiment of FIGS. 4–6.

Figure 13:
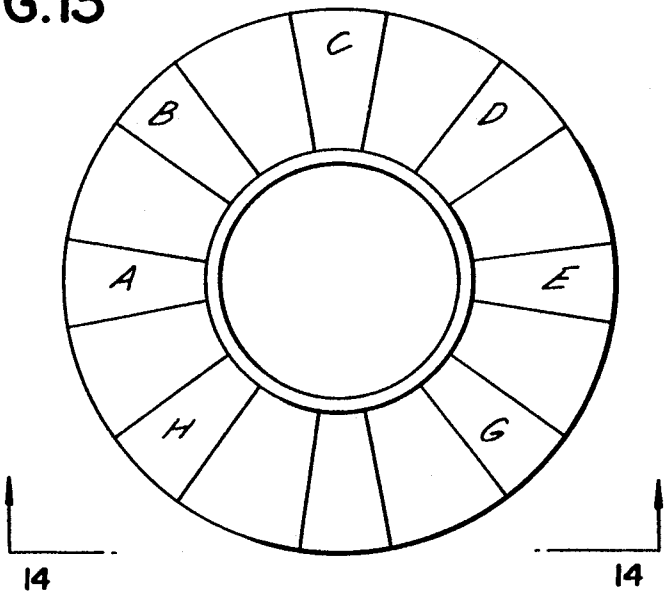
FIG. 13 is a front view of the stator of FIG. 12.
Figure 14:
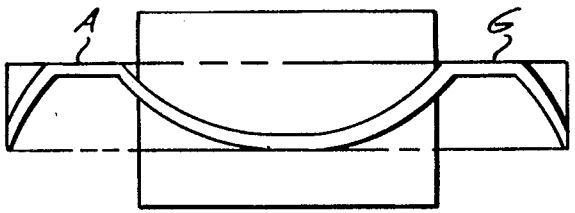
FIG. 14 is a bottom view of the stator of FIG. 12.
Figure 12:
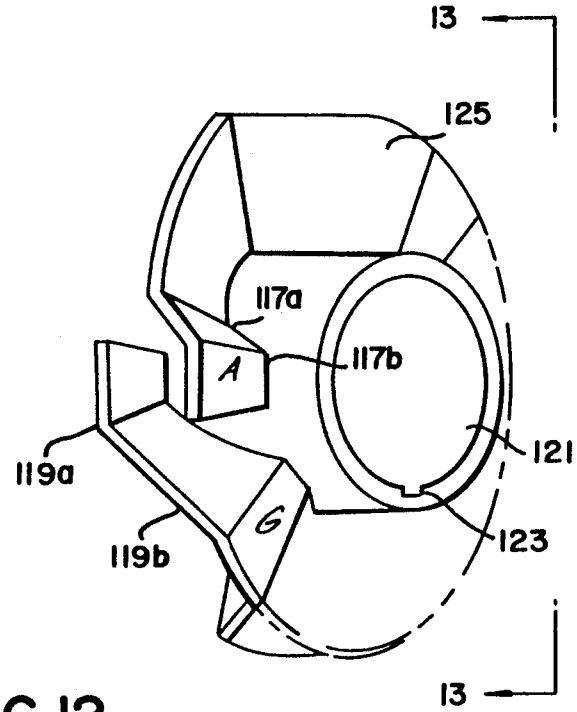
FIG. 12 is a perspective view of the stator of the second embodiment of the present invention.

FIG. 12 is a perspective view of the flow directing stator 111. The stator 111 comprises a hub 121 with a keyway 123 and a wall portion 125. The wall portion 125 has a plurality of sections 125*a*–125*k* (not shown in FIG. 12) which can be seen in FIG. 13 which is a full layout of a plurality of flow directing stators and turbine blade stages. FIG. 13 is an elevational view in plane 13—13 of FIG. 12, and FIG. 14 is a side view of FIG. 13 in plane 14—14. The surfaces of diverter portions 117 and wall portions 125 in the corresponding FIGS. 11–15, have been designated by letters A–G.

Figure 15:
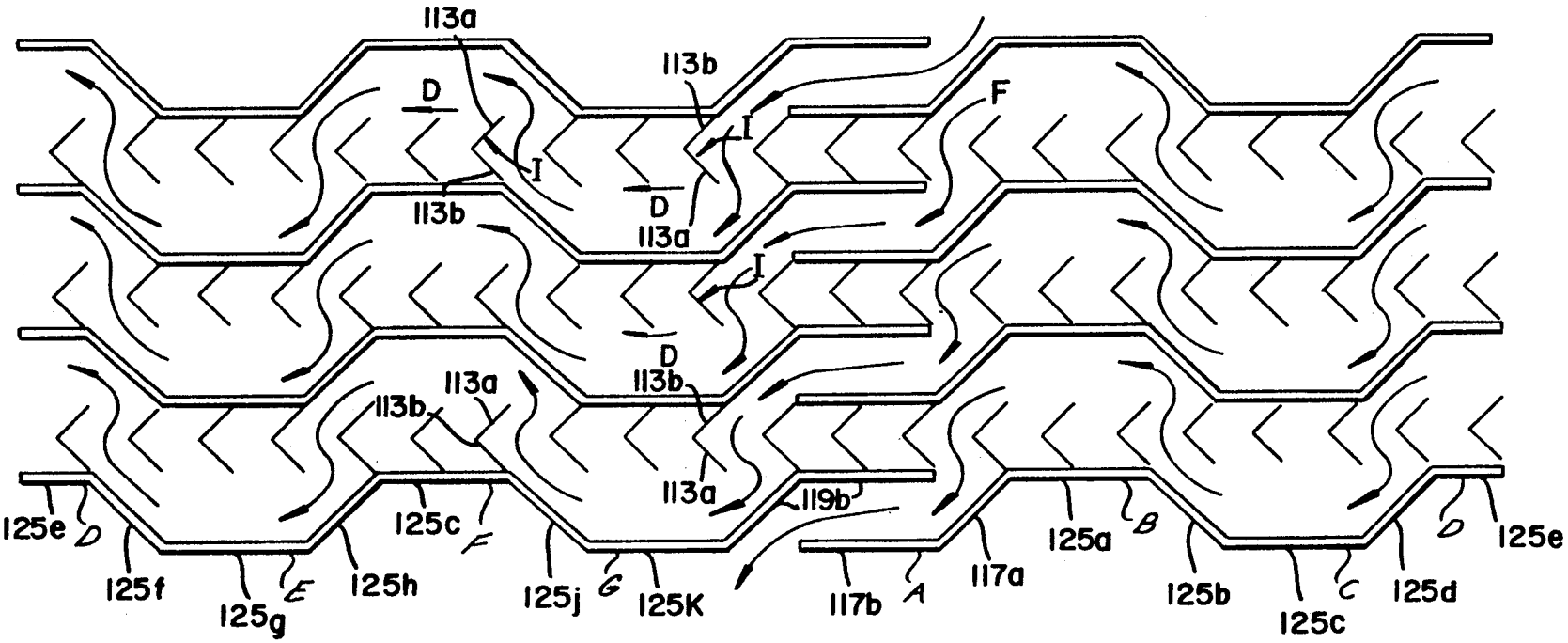
FIG. 15 is a partial layout illustrating the flow of fluid through a third embodiment of the turbine of the present invention.

The flow through the turbine in the embodiment of FIGS. 11–15 is illustrated by the arrows F in FIG. 15. This flow causes impulse forces on the outer halves 113*a* of the turbine blades 113. The inner halves 113*b* of the turbine blades 113 do not have any significant forces acting thereon, but rather, act with corresponding diverter wall portions 125*a*, 125*e* and 125*i* to form a substantial seal therebetween. The seals ensure that the flow is as indicated by arrows F, rather than through the space between the turbine blades and the wall portions 125*a*, 125*e* and 125*i*. The impulse forces on the turbine blades 113*a* are the same impulse forces described above with respect to the embodiment of FIGS. 4–9. As can be seen however, in this embodiment there are no substantial drag forces on the turbine blades. The lack of substantial drag forces occurs because centrifugal force on the flow moves the fluid towards the outside against wall portions 125*c*, 125*k* and 125*g* which are away from the edges of the turbine blades. This embodiment is the limit or the dynamic force, because "m" has been increased to provide the maximum dynamic force.

Figure 16:
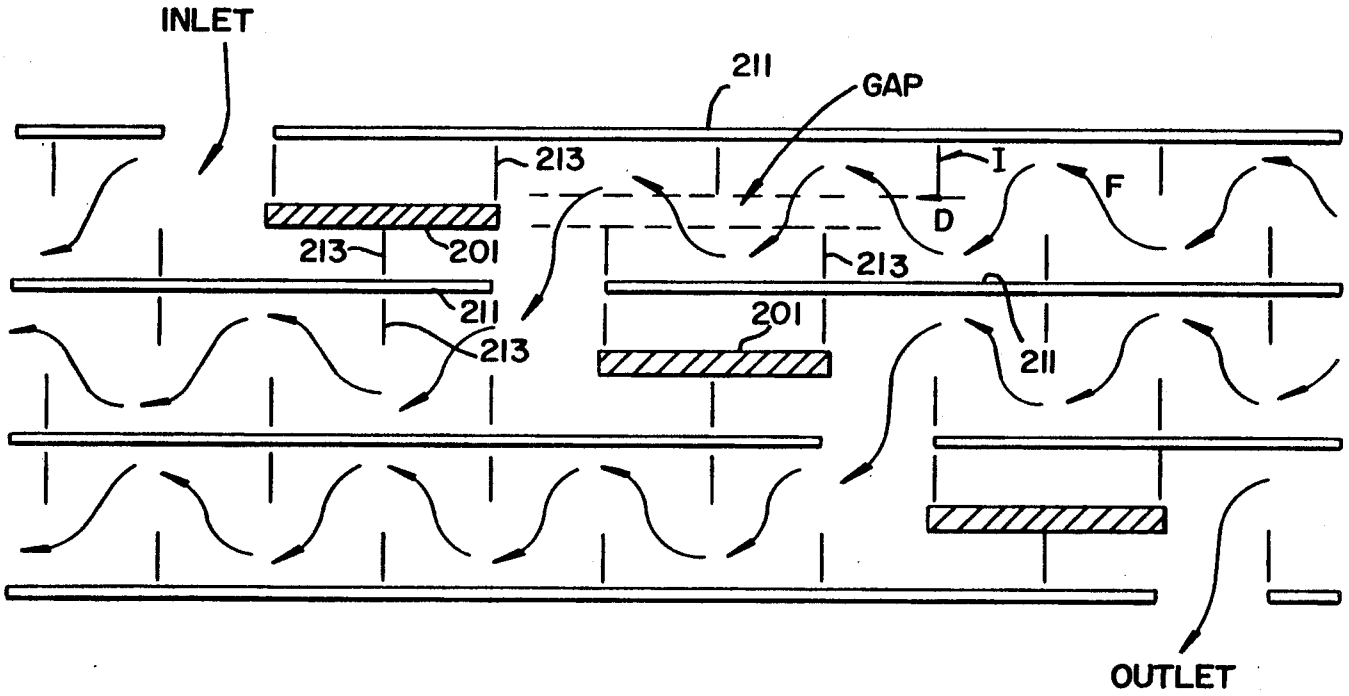
FIG. 16 is a partial layout illustrating the flow of fluid through a fourth embodiment of the turbine of the present invention.

FIG. 16 shows a fourth embodiment of the turbine of the present invention. In this embodiment, the blades 213 are alternately attached to the outside rotor rim (not shown). A sealing wall members form a seal with one side of blades 213, and the other side of blades 213 form a seal with stator 211. Flow is in one direction around the annular space and is almost 360° at which point it flows through the outlet into the next stage. The sinuous path of the flow F produces drag forces D on the tips or edges of the blades 213 and additionally produces impulses I on the surfaces of the blades. The drag and dynamic forces can be calculated in accordance with the equations set forth above. However, since the path is not very well defined, the equations have to be effected by coefficients determined experimentally.

Instead of blades, planar or rounded bodies can be used and attached to the rotor rim to eliminate eddy currents and turbulence and to enhance impulses on the slanted surfaces to produce the desired number of smooth changes of direction along the annular channels.

FIGS. 17*a*–17*d* illustrate a fifth embodiment of the turbine of the present invention. In this embodiment, the turbine is substantially a pure drag turbine which is simple, versatile, has high torque and a comparatively high efficiency. Additional turbine blades can be added to produce additional forces either drag forces or dynamic forces to modify the performance of the turbine, if desired.

Figure 17A:
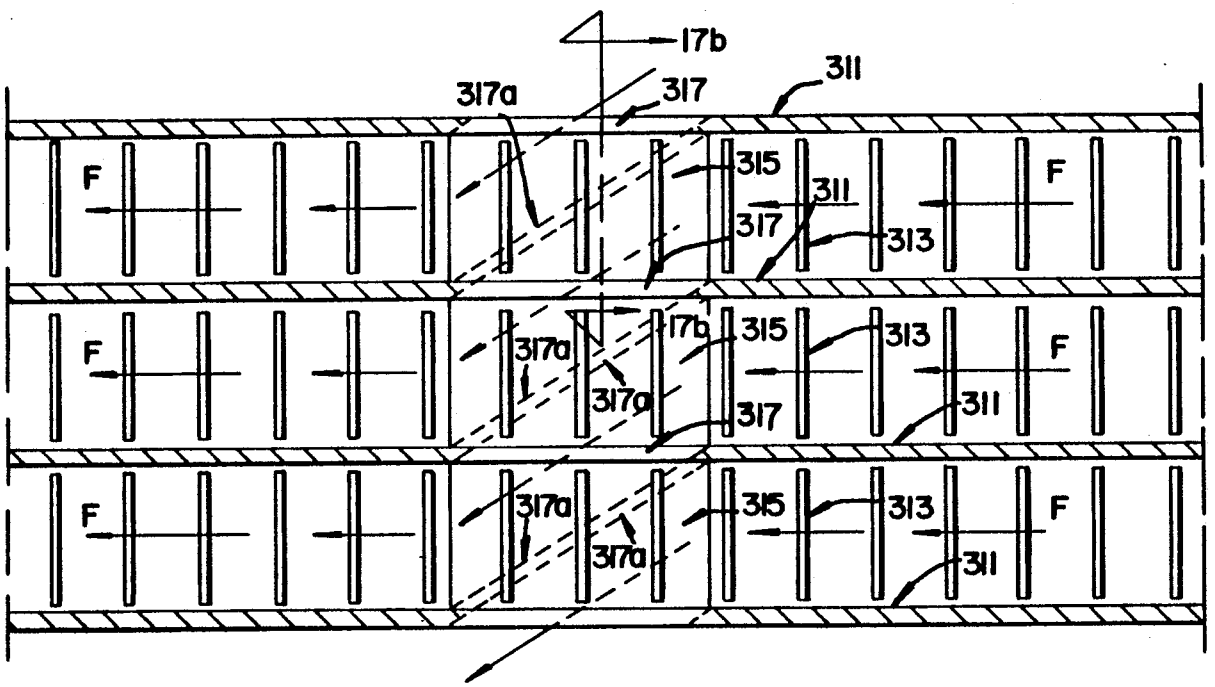
FIG. 17*a* is a partial sectional view of a fifth embodiment of the turbine of the present invention.
Figure 17C:
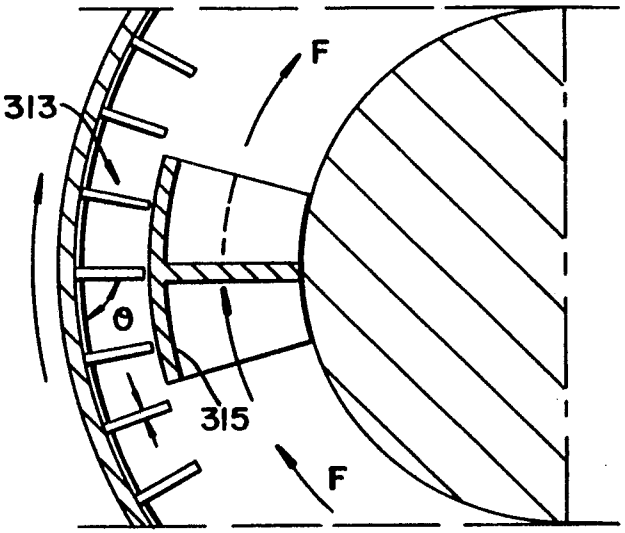
FIG. 17*c* is a sectional view of Section 17B–17B' of FIG. 17*b*.
Figure 17B:
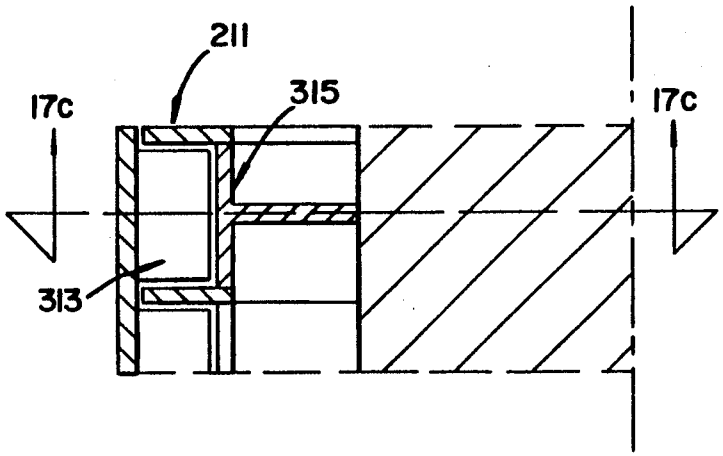
FIG. 17*b* is a partial sectional view of Section 17A–17A' of FIG. 17*a*.
Figure 17D:
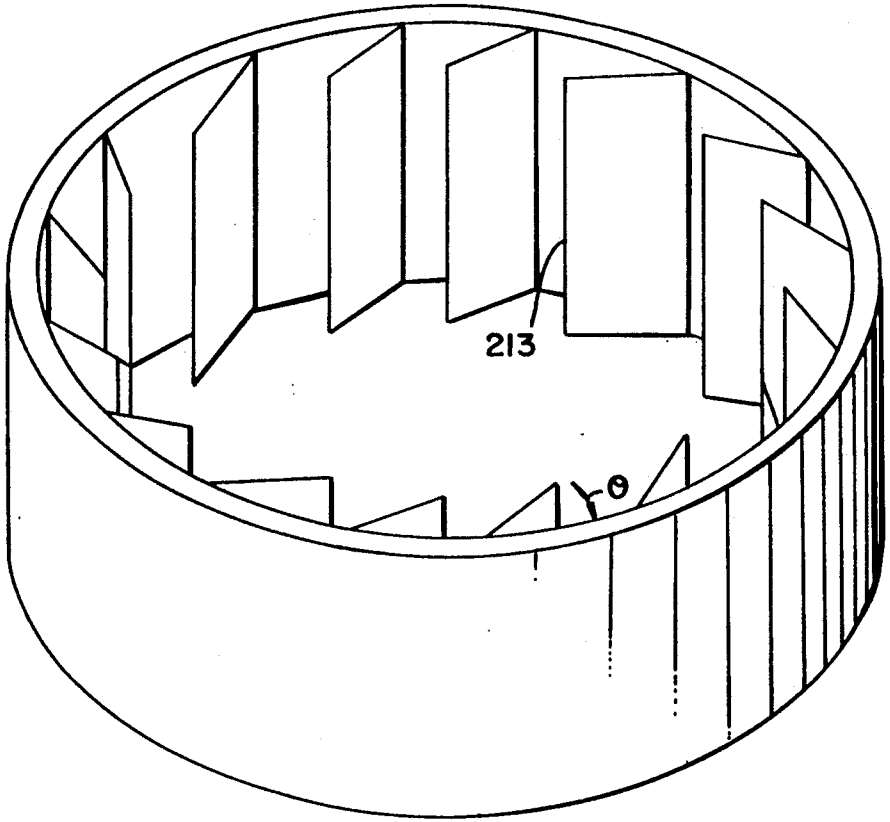
FIG. 17*d* is a perspective view of the turbine rotor of the fifth embodiment of the present invention.

Referring to FIGS. 17*a*–17*d*, the flow indicated the arrow F, flows through the turbine with the intermediate seal 315 at the diagonal entrance of the next stage. The turbine has blades 313 which contact seals 315. The seal 317*a* and the diagonal diverter divert the flow through opening 317 in the wall of stator 311. The flow channel is cylindrical and covers almost 360° and is coaxial and parallel with the cylindrical space covered by the rotor and its blades. In other words, the flow is cylindrical and intermediate between the edges of the blades and the internal hub, as shown in FIG. 17*c*.

The blade length, thickness, angle of inclination, as well as separation between blades, can be varied. All of these variables affect the drag coefficient λdr and thus the ultimate drag force, velocity and efficiency.

The drag action in this embodiment of the present invention is generally better than in the other embodiments of the present invention.

In the fifth embodiment, since the flow through the channels is cylindrical and parallel to the rotor and blades, the blades do not cross or deviate from the direction of the flow, to produce an impulse, except in the change of stages. The change of direction of the flow from one stage to the next is produced by the seal and stator and hence friction loss, and correspondingly hydraulic head loss are small.

Figures 18A, 18B:
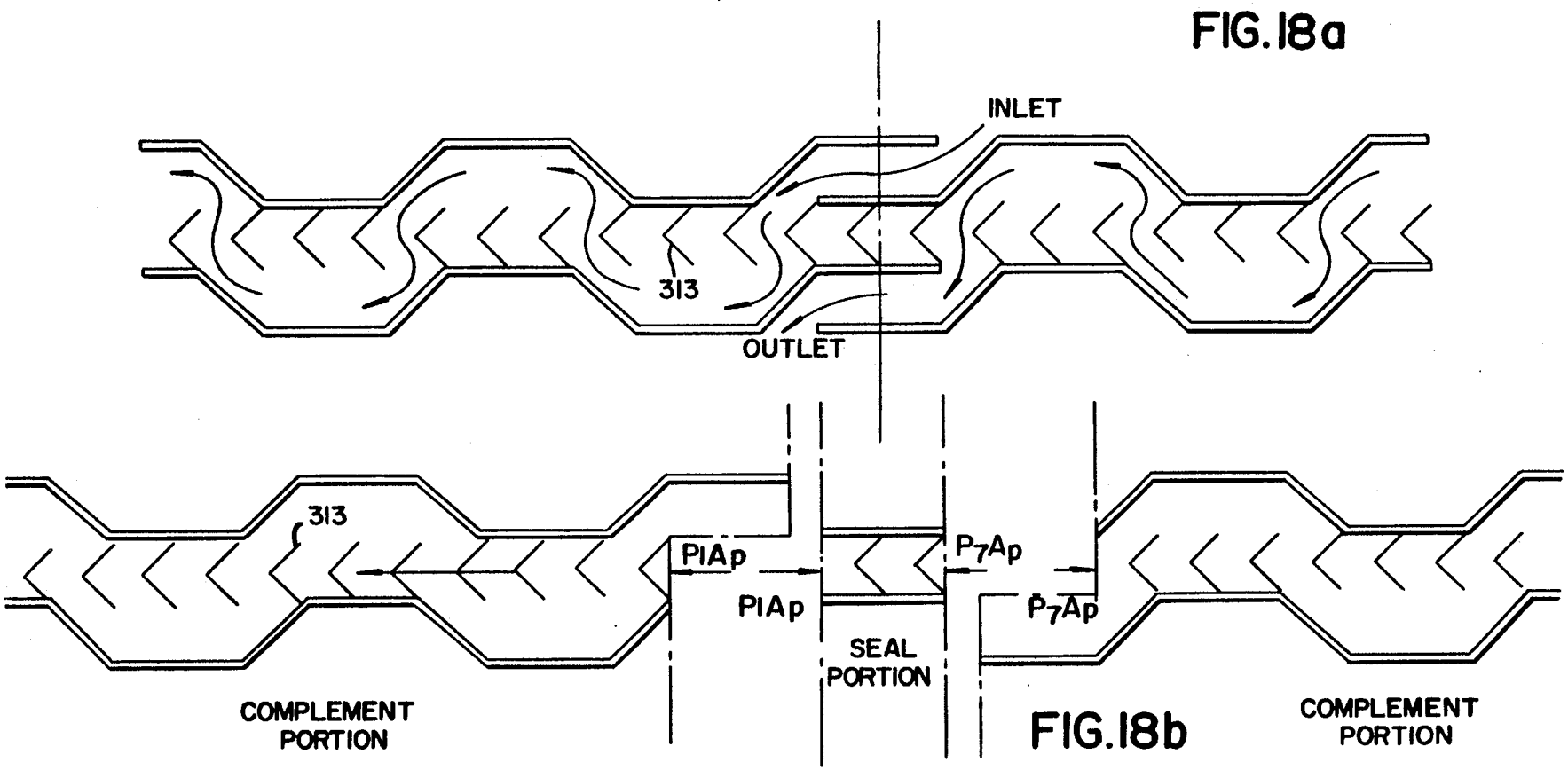
FIGS. 18*a* and 18*b* are partial layouts illustrating the intermediate seal for the drag and dynamic embodiment of the present invention.

The following is an explanation of the manner in which the intermediate seals operate in the present invention. Considering one stage of the turbine with the drag and dynamic actions, such as in FIG. 18*a* and 18*b*, which shows schematically a section of the channel with seven changes of direction. The rotor is shown divided in two portions; one is the seal portion in the change of stage, and the other is the complement portion for the rest of the rotor.

The equilibrium equations for each one of the those portions are:

$$\overset{+}{\overleftarrow{\Sigma}} F_{seal} = -P_1Ap + P_7Ap = -(P_1 - P_7)Ap$$

(seal portion)

$P_1$ and $P_7$ are the pressures at the inlet and outlet of the stage, and Ap is the area of the blades on which the pressures act.

$$\overset{+}{\overleftarrow{\Sigma}} F_{comp} = P_1Ap - P_7Ap + Fdr + Fdy =$$

(complement portion)

$$(P_1 - P_7)Ap + Fdr + Fdy$$

The total force acting on the rotor will be:

$$\begin{aligned} F_T &= \Sigma F_{seal} + \Sigma F_{comp} \\ &= -(P_1 - P_7)Ap + (P_1 - P_7)Ap + Fdr + Fdy \\ F_T &= Fdr + Fdy \end{aligned}$$

Thus, the forces coming from pressure acting on the section cancel each other.

Although the present invention is shown as a turbine, the principles of the invention can also be used for a pump, blower or compressor.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

I claim:

1. A turbine for driving a downhole motor, said turbine being driven by the flow of a fluid therethrough said turbine comprising:

(a) a housing;

(b) a shaft positioned in said housing, said shaft rotating about the longitudinal axis thereof;

(c) a rotor assembly having a plurality of turbine stages mounted on said shaft for rotation therewith, each turbine stage including a rim means coaxial with said shaft and a plurality of turbine blades fixed to said rim means; and (d) a stator assembly having a plurality of flow directing stator means, each of said stator means being positioned between adjacent turbine stages, each of said stator means having a wall means and diverter means, wherein said wall means are perpendicular to the axis of said shaft and said diverter means are at an angle of less than 90° with respect to the axis of said shaft, wherein at least one of said turbine blades and said diverter means form a seal for preventing the flow from passing therebetween, such that flow through a turbine stage is perpendicular to the axis of said shaft in the space between adjacent wall means and wherein said diverter means are positioned with respect to said wall means for diverting flow from the turbine stage to an adjacent turbine stage.

2. A turbine as set forth in claim 1, wherein said turbine blades are positioned between adjacent stator means such that the flow between the wall means of the adjacent stator means contacts the edges of said turbine blades thereby imparting a drag force on said turbine blades whereby said turbine is rotated.

3. A turbine as set forth in claim 1, wherein said turbine blades are positioned between adjacent stator means such that flow between adjacent diverter means impinges upon the face surface of said turbine blades thereby imparting a dynamic force on said turbine blades whereby said turbine is rotated.

4. A turbine as set forth in claim 1, wherein said turbine blades are positioned between adjacent stator means such that flow between the wall means of adjacent stator means contacts the edges of said turbine blades, thereby imparting a drag force on said turbine blades and flow through adjacent diverter means impinges upon the face surface of said turbine blades, thereby imparting a dynamic force on said turbine blades, whereby said turbine blades are rotated by the combination of the drag forces and dynamic forces thereon.

5. A turbine as set forth in any one of claim 1, 2 or 4, wherein each of said wall means are planar in single plane perpendicular to the axis of said shaft.

6. A turbine as set forth in any one of claims 1, 2 and 4, wherein said turbine blades are mounted on said rim such that the flow through a turbine stage contacts at least one the side edges of said turbine blades.

7. A turbine as set forth in claim 6, wherein said turbine blades are mounted on said rim such that the flow through a turbine stage contacts both side edges of said turbine blades.

8. A turbine as set forth in any one of claims 1, 2 and 4, wherein said turbine blades are mounted on said rim such that the flow through a turbine stage contacts the front edges of said turbine blades.

9. A turbine as set forth in any one of claims 1-4, wherein each of said wall means comprises:

(a) a plurality of planar first sections perpendicular to the axis of said shaft, wherein at least one of said planar first sections is not coplanar with at least another of said planar first sections; and (b) a plurality of planar second sections positioned between and interconnecting said planar firs sections.

10. A turbine as set forth in any one of claims 1, 2 and 4, further including center seal means for forming a seal with a side edge of at least two of said turbine blades, wherein when the seal is formed, the other side edge of said at least one turbine blades forms the seal with said stator means.

11. A turbine as set forth in claim 1, wherein said at least one turbine blade which forms a seal with said diverter means is at least three turbine blades.

* * * * *